US010976706B2

(12) United States Patent
Zaugg et al.

(10) Patent No.: US 10,976,706 B2
(45) Date of Patent: Apr. 13, 2021

(54) BIMETALLIC DEVICE SENSITIVE TO TEMPERATURE VARIATIONS

(71) Applicant: Montres Breguet S.A., L'Abbaye (CH)

(72) Inventors: Alain Zaugg, Le Sentier (CH); Davide Sarchi, Zurich (CH)

(73) Assignee: Montres Breguet S.A., L'Abbaye (CH)

( * ) Notice: Subject to any disclaimer, the term of this patent is extended or adjusted under 35 U.S.C. 154(b) by 333 days.

(21) Appl. No.: 15/422,882

(22) Filed: Feb. 2, 2017

(65) Prior Publication Data

US 2017/0255165 A1 Sep. 7, 2017

(30) Foreign Application Priority Data

Mar. 7, 2016 (EP) ..... 16158884

(51) Int. Cl.
*G04B 17/22* (2006.01)
*G04B 17/06* (2006.01)

(52) U.S. Cl.
CPC ..... *G04B 17/222* (2013.01); *G04B 17/063* (2013.01); *G04B 17/227* (2013.01)

(58) Field of Classification Search
CPC .... G04B 17/063; G04B 17/22; G04B 17/222; G04B 17/325; G04B 17/227
See application file for complete search history.

(56) References Cited

U.S. PATENT DOCUMENTS

| | | | | |
|---|---|---|---|---|
| 387,567 | A | 8/1888 | Pickert | |
| 631,103 | A | 8/1899 | Borel | |
| 9,016,932 | B2 * | 4/2015 | Hessler | G04B 17/066 368/168 |
| 9,188,956 | B2 * | 11/2015 | Nakajima | G04B 15/06 |
| 9,428,382 | B2 * | 8/2016 | Hessler | G04B 17/06 |
| 2004/0174775 | A1 * | 9/2004 | Muller | G04B 17/063 368/177 |
| 2010/0034057 | A1 * | 2/2010 | Levingston | G04B 17/222 368/175 |
| 2014/0241134 | A1 * | 8/2014 | Niwa | G04B 17/22 368/127 |
| 2014/0286143 | A1 * | 9/2014 | Stranczl | G04B 18/025 368/178 |
| 2015/0309476 | A1 * | 10/2015 | Rhul | G04D 7/004 29/896.31 |

OTHER PUBLICATIONS

European Search Report dated Aug. 19, 2016 in European Application 16158884.3, filed on Mar. 7, 2016 (with English Translation of Categories of cited documents).

* cited by examiner

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A bimetallic device, the difference in expansion coefficient of which is between 10 and 30 $10^{-6}$ $K^{-1}$, for providing a resonator with thermal compensation via the balance wheel.

25 Claims, 5 Drawing Sheets

BIMETALLIC DEVICE SENSITIVE TO TEMPERATURE VARIATIONS

This application claims priority from European Patent application 16158884.3 of Mar. 7, 2016, the entire disclosure of which is hereby incorporated herein by reference.

FIELD OF THE INVENTION

The invention relates to a bimetallic device sensitive to temperature variations and particularly to such a device comprising two materials, for which the difference between the expansion coefficients allows a variation in curvature according to the temperature change.

BACKGROUND OF THE INVENTION

Bimetallic devices are known for manufacturing compensating balance wheels with a cut-out rim that is formed by two half-rings, each made up of a first steel layer soldered on a second brass layer. Thus formed, the rim opens when the temperature drops and closes when the temperature rises in order to compensate for the effect of the temperature on the flexibility of a balance spring.

SUMMARY OF THE INVENTION

The object of the present invention is to overcome all or part of the disadvantages of the known devices by proposing an alternative bimetallic device to those described above.

To this end, the invention relates to a bimetallic device comprising at least one first silicon-based layer and at least one second metal-based layer, characterised in that said at least one first and at least one second layers are arranged to attach to each other so that the curvature of the bimetallic device varies according to the temperature.

It is thus understood that the difference in the expansion coefficient of the bimetallic device is between approximately 10 and 30 $10^{-6}$ $K^{-1}$ depending on the materials used. This difference, which is much higher than that of the steel-brass pairing of approximately 6 $10^{-6}$ $K^{-1}$, allows the bimetallic device to have higher temperature sensitivity.

Furthermore, it is possible to work the silicon-based and metal-based materials into a wide variety of shapes and with high manufacturing precision. By way of an example, dry etching the silicon-based material and electroforming the metal-based material on the silicon-based material provides manufacturing precision of approximately one micron.

According to further advantageous variants of the invention:

said at least one first silicon-based layer comprises monocrystalline silicon, doped monocrystalline silicon, polycrystalline silicon, doped polycrystalline silicon, porous silicon, silicon oxide, quartz, silica, silicon nitride or silicon carbide;

said at least one second metal-based layer comprises silver, magnesium, lead, thallium, nickel, copper, zinc, gold, aluminium or indium or vulcanite;

under the ambient temperature and pressure conditions the bimetallic device forms a curved strip;

said at least one first and at least one second layers are attached to each other by nesting and/or by using a bonding material and/or said at least one second layer is electroformed on said at least one first layer;

the bimetallic device comprises a fixing base integral with one of said at least one first and at least one second layers that allows the bimetallic device to be mounted on a part;

the bimetallic device comprises a block integral with the end of one of said at least one first and at least one second layers that allows the influence of the bimetallic device to be enhanced;

the bimetallic device comprises adjustable stop means that allow the minimum and/or maximum curvature variations of the bimetallic device to be limited;

the bimetallic device comprises a plurality of first layers arranged to attach to a single second layer, or conversely, a plurality of second layers arranged to attach to a single first layer.

According to a first embodiment, the invention relates to a compensating balance wheel comprising at least one bimetallic device according to any of the preceding variants.

Consequently, the bimetallic device according to the invention particularly can be advantageously used to provide a resonator with main or auxiliary thermal compensation via the balance wheel.

According to a first alternative, the compensating balance wheel comprises a cut-out rim that is formed by two bimetallic devices, each connected by at least one arm to a central opening in order to modify the inertia of the balance wheel according to the temperature.

According to a second alternative, the compensating balance wheel comprises a one-piece rim that is connected by at least one arm to a central opening and said at least one bimetallic device is mounted on the rim in order to modify the inertia of the balance wheel according to the temperature.

According to a third alternative, the compensating balance wheel comprises a one-piece rim that is connected by at least one arm to a central opening and said at least one bimetallic device is mounted on said at least one arm in order to modify the inertia of the balance wheel according to the temperature.

According to a second embodiment, the invention relates to a compensating index comprising at least one bimetallic device according to any of the preceding variants.

Consequently, the bimetallic device according to the invention particularly can be advantageously used to provide a resonator with high-precision auxiliary thermal compensation through the indexing.

According to a first alternative, the compensating index thus can comprise a gap that is arranged to receive a hairspring and is connected to said at least one bimetallic device in order to modify the position of the gap according to the temperature.

According to a second alternative, the compensating index can comprise a gap that is arranged to receive a hairspring, the size of the gap being controlled by said at least one bimetallic device in order to modify the gap according to the temperature.

According to a third embodiment, the invention relates to a temperature sensor comprising at least one bimetallic device according to any of the preceding variants.

Consequently, the bimetallic device according to the invention particularly can be advantageously used for high-precision temperature measurement.

The temperature sensor thus can comprise a pointer and a flexible device for tracking the movement of said at least one bimetallic device in order to modify the position of the pointer according to the temperature.

Finally, according to a fourth embodiment, the invention relates to a compensating balance spring comprising at least one bimetallic device according to any of the preceding variants.

Consequently, the bimetallic device according to the invention particularly can be advantageously used to provide a resonator with high-precision auxiliary thermal compensation through the pinning point.

The compensating balance spring thus can comprise an overcoil connected to said at least one bimetallic device that is arranged to be fixed to a beam in order to modify the active length of the compensating balance spring according to the temperature.

BRIEF DESCRIPTION OF THE DRAWINGS

Further features and advantages will become apparent from the following description, which is provided by way of a non-limiting example, with reference to the accompanying drawings, in which.

DETAILED DESCRIPTION OF THE PREFERRED EMBODIMENTS

The invention relates to a bimetallic device sensitive to temperature variations. The invention has been developed for horological applications for auxiliary thermal compensation or for mechanical temperature measurement. However, the bimetallic device cannot be limited to applications in the horological field.

The bimetallic device according to the invention comprises at least one first silicon-based layer and at least one second metal-based layer.

Said at least one first silicon-based layer can comprise monocrystalline silicon, doped monocrystalline silicon, polycrystalline silicon, doped polycrystalline silicon, porous silicon, silicon oxide, quartz, silica, silicon nitride or silicon carbide. Of course, when the silicon-based material is in a crystalline phase, any crystalline orientation can be used.

Furthermore, said at least one second metal-based layer can comprise silver and/or magnesium and/or lead and/or thallium and/or nickel and/or copper and/or zinc and/or gold and/or aluminium and/or indium and/or vulcanite.

According to the invention, said at least one first and at least one second layers are arranged to attach to each other so that the curvature of the bimetallic device varies according to the temperature. Indeed, the strip that is formed by said at least one first and at least one second layer curves with the increase in temperature on the side where the expansion coefficient is the weakest.

Furthermore, this particularly means that the bimetallic device can comprise a plurality of first layers arranged to attach to a single second layer or, alternatively, that a plurality of second layers are arranged to attach to a single first layer.

Thus, for the horological applications, the aim is to find a difference in the expansion coefficient of the bimetallic device of between approximately 10 and 30 $10^{-6}$ $K^{-1}$ and to find low sensitivity to the magnetic fields. In a preferred manner, the monocrystalline silicon—nickel/phosphorus alloy pairing is used.

Therefore, the monocrystalline silicon comprises a linear expansion coefficient $\alpha$ at 25° C. of approximately 2.5 $10^{-6}$ $K^{-1}$, whereas the metals or metallic alloys generally comprise linear expansion coefficients $\alpha$ at 25° C. that are substantially between 13 and 32 $10^{-6}$ $K^{-1}$. It is thus understood that the difference in expansion coefficient of the bimetallic device allows high temperature sensitivity.

According to the invention, under the ambient temperature and pressure conditions (ATPC) that correspond to a temperature of 25° C. and to a pressure of 100 kPa, the bimetallic device preferably forms a curved strip.

Figure 1:
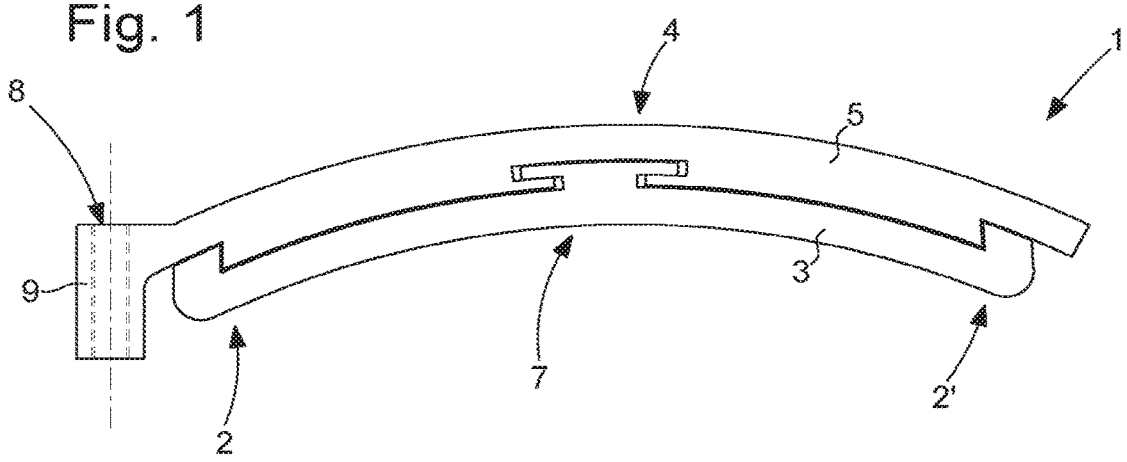
FIG. 1 shows a schematic representation of a bimetallic device according to the invention.

A first example of a bimetallic device 1 is shown in FIG. 1. The bimetallic device 1 comprises a first silicon-based layer 3 and a second metal-based layer 5. As explained above, the strip 7 that is formed by said first and second layers 3, 5 curves with the increase in temperature on the side where the expansion coefficient is the weakest, i.e. the first silicon-based layer 3.

As shown in FIG. 1, said at least one first and at least one second layers 3, 5 are attached to each other by nesting. Thus, nesting means 2, 2', 4 can be seen that are formed either by a groove-hook assembly 4 or by catch-rib assemblies 2, 2'.

Of course, in a further or alternative manner, said at least one first and at least one second layers can be attached to each other by using a bonding material or by electroforming.

More specifically, in a further or alternative manner, the strip 7 can be rigidly connected by bonding or brazing said first 3 and second 5 layers or the second layer 5 can be electroformed on the first layer 3.

As shown in FIG. 1, the bimetallic device 1 further comprises a fixing base 9 integral with one of said first 3 and second 5 layers that allows the bimetallic device 1 to be mounted on another part. In the example of FIG. 1, the fixing base 9 is integrally formed with the second metal-based layer 5 and comprises a through hole 8 that can be tapped.

Figure 2:
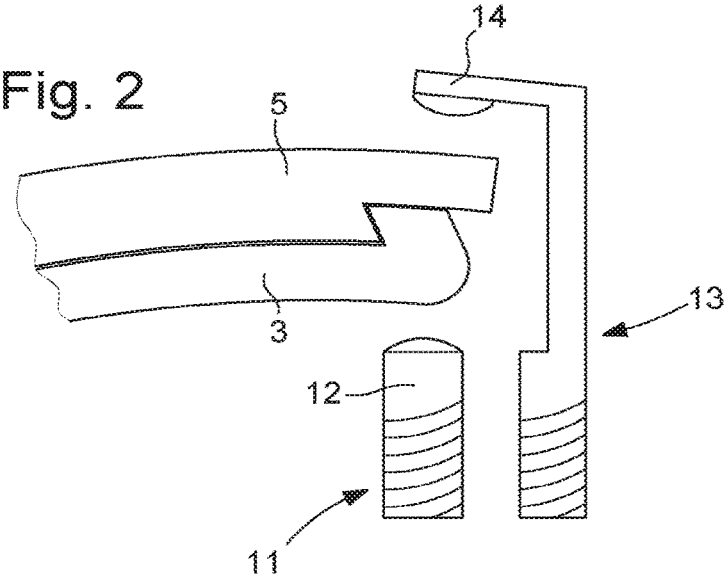
FIGS. 2 to 4 show partial representations of variants of a bimetallic device according to the invention.
Figure 3:
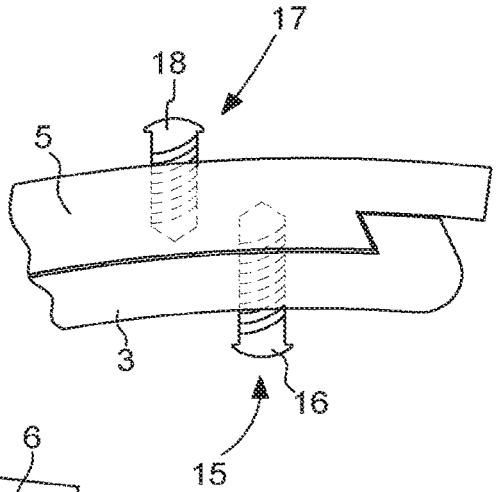

According to the variants shown in FIGS. 2 and 3, the bimetallic device can comprise adjustable stop means that allow the minimum and/or maximum curvature variations of the bimetallic device to be limited. Indeed, it can be worthwhile for the part on which the bimetallic device is added to be able to limit any influence over only a certain temperature range, i.e. above a predefined temperature, below a predefined temperature or between two predefined temperatures.

FIG. 2 shows two types of adjustable stop means 11, 13 that allow the minimum and/or maximum variations of curvature of the bimetallic device to be limited. Indeed, depending on the choice of materials for the layers 3, 5, it is possible to determine whether to limit the movement of the strip to less curvature or to more curvature or to both. The first adjustable stop means 11 thus comprise a threaded cylindrical stop 12 that is intended to limit the movement of the strip through contact with the first layer 3, whereas the second adjustable stop means 13 comprise an L-shaped stop 14 that comprises a threaded vertical section and is intended to limit the movement of the strip through contact with the second layer 5.

Alternatively, FIG. 3 shows two types of adjustable stop means 15, 17 that allow the minimum and/or maximum curvature variations of the bimetallic device to be limited. Indeed, depending on the choice of materials for the layers 3, 5, it is possible to determine whether to limit the movement of the strip to less curvature or to more curvature or to both. The first adjustable stop means 15 thus comprise a threaded cylindrical stop 16 that is intended to limit the movement of the strip through contact with a part facing the first layer 3, whereas the second adjustable stop means 17 comprise a threaded cylindrical stop 18 that is intended to limit the movement of the strip through contact with a part facing the second layer 5.

Figure 4:
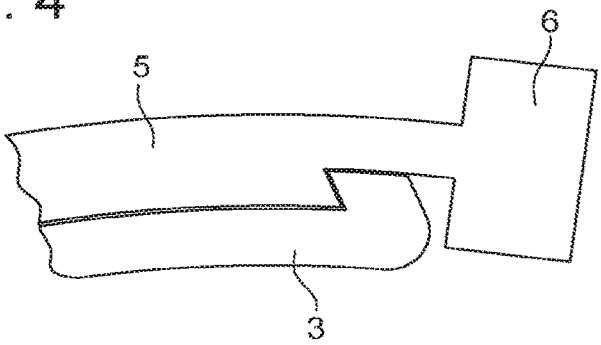

According to a third variant shown in FIG. 4, the bimetallic device can further comprise a block 6 that can be integral with the end of one of said at least one first and at least one second layers 3, 5 in order to enhance the influence of the bimetallic device. Indeed, it can be worthwhile for the part on which the bimetallic device is added to be able to enhance the influence by modifying the centre of mass of the bimetallic device.

Alternatively, the block 6 can be an inertia block fixed on the end of one of said at least one first and at least one second layers 3, 5 in the same way as the first and second adjustable stop means 15, 17. The inertia block thus can be formed from a third material, which is denser, for example, than said at least one first and at least one second layers 3, 5.

A first embodiment of the invention relates to a compensating balance wheel comprising at least one bimetallic device according to any of the preceding variants. It is thus understood that the bimetallic device according to the invention particularly can be advantageously used to provide a resonator, which may or may not comprise a compensating balance spring, with auxiliary or main thermal compensation at the balance wheel.

Figure 5:
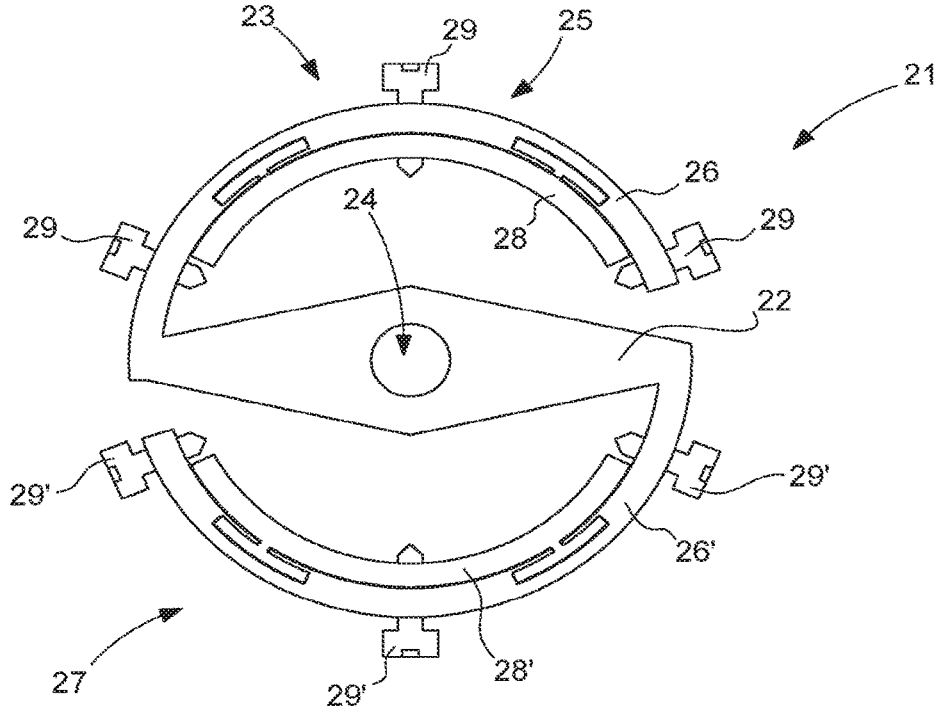
FIGS. 5 to 9 show alternative representations of a first embodiment using a bimetallic device according to the invention.

According to a first alternative shown in FIG. 5, the compensating balance wheel 21 comprises a cut-out rim 23 formed by two bimetallic devices 25, 27 respectively formed by at least one first and at least one second layer 28, 28', 26, 26'. Each bimetallic device 25, 27 is connected by at least one arm 22 to a central opening 24 in order to modify the inertia of the balance wheel 21 according to the temperature. FIG. 5 shows that the second layers 26 and/or 26' and/or said at least one arm 22 and/or the opening 24 can be one-piece. It can also be seen that inertia blocks 29, 29' are used to adjust the inertia of the compensating balance wheel 21.

It is thus understood that the bimetallic devices 25, 27 according to the invention are advantageously used to provide a resonator, which may or may not comprise a compensating balance spring, with auxiliary or main thermal compensation at the balance wheel. It is also understood that, depending on the thermal compensation to be provided, the materials and the geometries that are used for the bimetallic device 25, 27 and, possibly, for the block/inertia block 6 and/or the fixing base 9 and/or the stop means 11, 13, 15, 17 will be selected in order to adjust the working of the timekeeping movement as precisely as possible. It is also possible for the position of the bimetallic device 25, 27 to be adjusted, i.e. its fixing position relative to the opening 24, as well as the angle that it forms relative to the arm 22, in order to optimise its use.

Of course, a plurality of bimetallic devices 25, 27 can be distributed over the same section of the cut-out rim 23 or at said at least one arm 22. It is also possible, in a manner similar to the example of FIG. 8, that the bimetallic device 25, 27 that is used comprises a plurality of first layers arranged to attach to a single second layer or, alternatively, that a plurality of second layers are arranged to attach to a single first layer.

Figure 6:
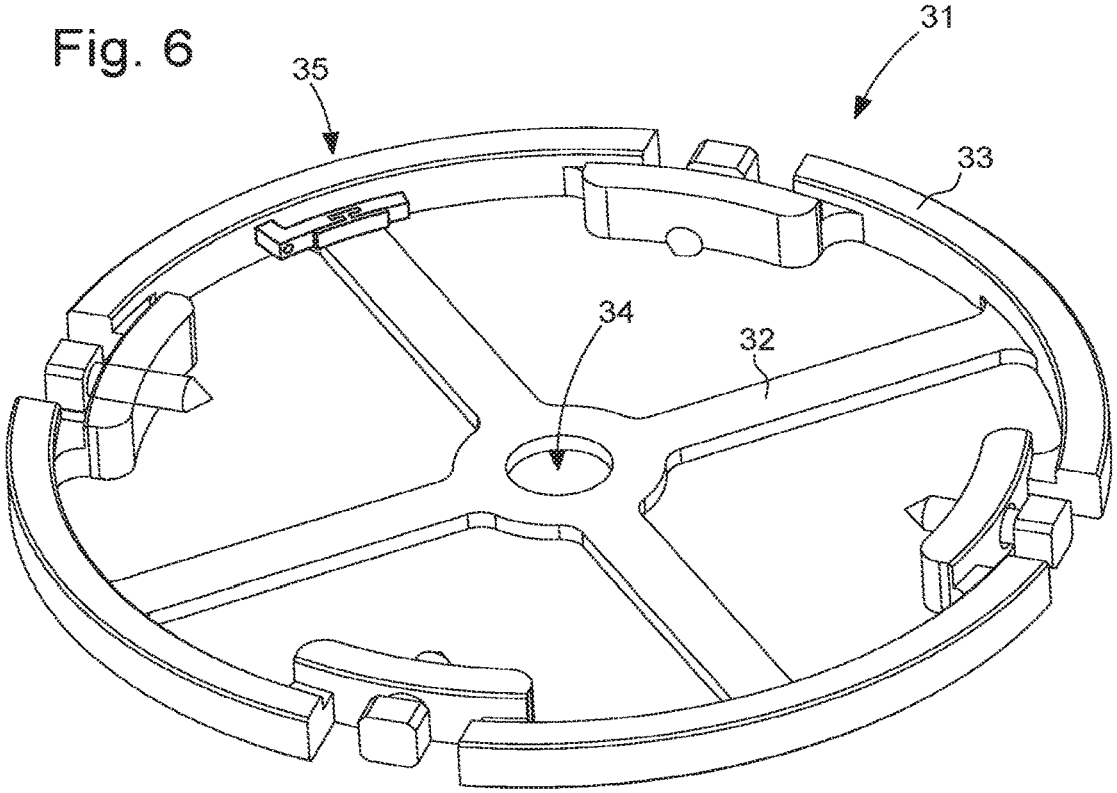
Figure 7:
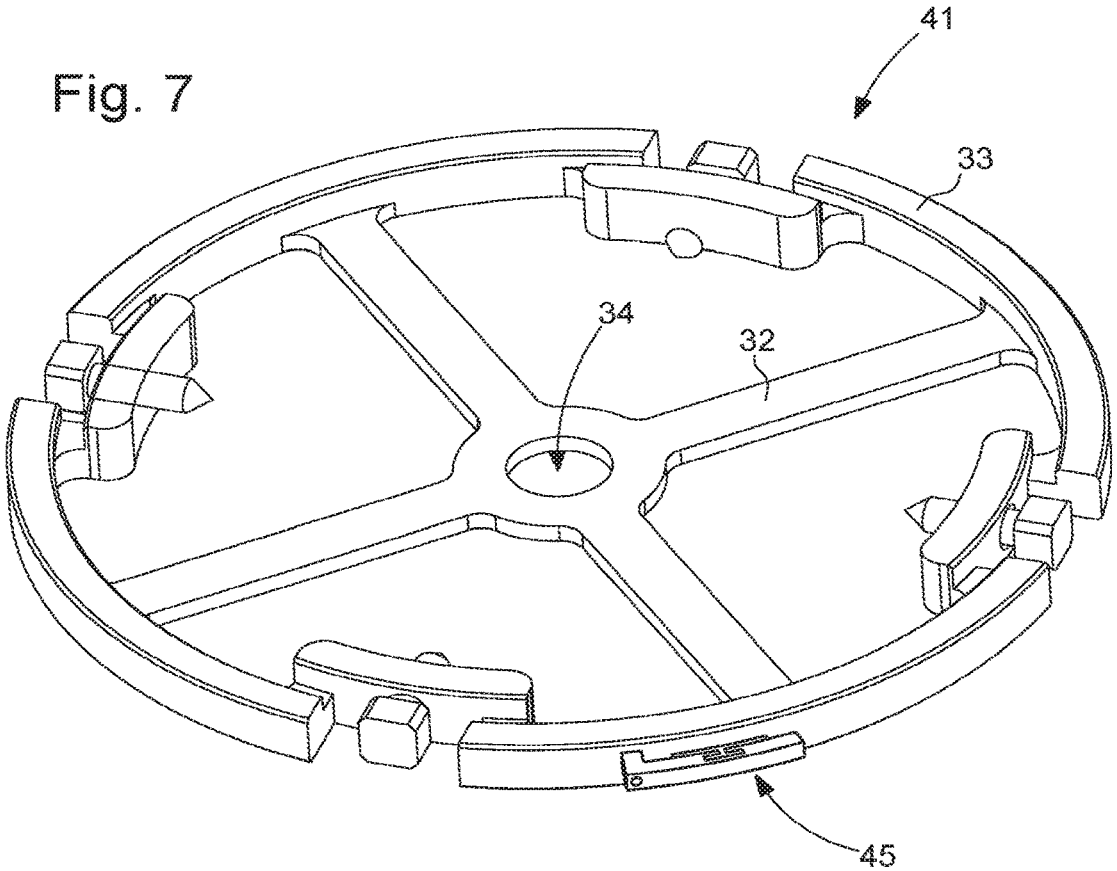
Figure 8:
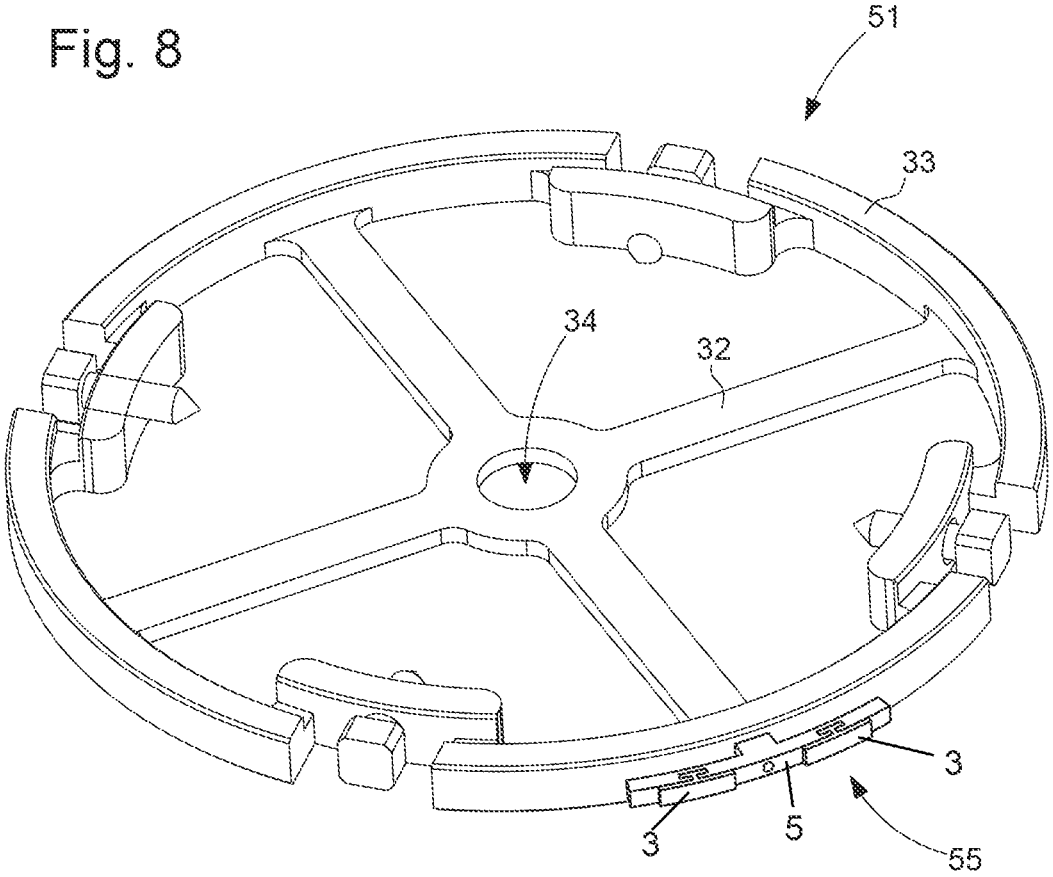

According to a second alternative shown in FIGS. 6 to 8, the compensating balance wheel 31, 41, 51 comprises a non-cut-out rim 33 that is connected by at least one arm 32 to a central opening 34. Furthermore, said at least one bimetallic device 35, 45, 55 is mounted on the rim 33 in order to modify the inertia of the compensating balance wheel 31, 41, 51 according to the temperature.

Depending on the choice of materials for the first and second layers, it is possible to determine whether to fix the bimetallic device to the internal diameter of the rim, as shown in FIG. 6, or to fix the bimetallic device to the external diameter of the rim, as shown in FIGS. 7 and 8, or to do both.

In the example of FIG. 7, the bimetallic device 45 comprises a strip, which is formed by a single first layer and a single second layer, and which is added onto the external diameter of the rim 33. Of course, a plurality of bimetallic devices 45 can be distributed over the external diameter of the rim 33.

It is also possible, as shown in FIG. 8, that the bimetallic device 55 that is mounted on the external diameter of the rim 33 comprises a plurality of first layers arranged to attach to a single second layer or, alternatively, that a plurality of second layers are arranged to attach to a single first layer.

It is thus understood that the bimetallic devices 45, 55 according to the invention are advantageously used to provide a resonator comprising a compensating balance spring with auxiliary thermal compensation at the balance wheel. It is particularly understood that, depending on the auxiliary compensation to be provided, the materials and the geometries that are used for the bimetallic device 45, 55 and, possibly, for the block/inertia block 6 and/or the fixing base 9 and/or the stop means 11, 13, 15, 17 will be selected in order to adjust the working of the timekeeping movement as precisely as possible. It is also possible to adjust the position of the bimetallic device 45, 55 on the rim 33 in order to optimise its influence.

In the example of FIG. 6, the bimetallic device 35 comprises a strip, which is formed by a single first layer and a single second layer and which is added onto the internal diameter of the rim 33. Of course, a plurality of bimetallic devices 35 can be distributed over the internal diameter of the rim 33.

It is also possible, in a manner similar to the example of FIG. 8, that the bimetallic device that is mounted on the internal diameter of the rim 33 comprises a plurality of first layers arranged to attach to a single second layer or, alternatively, that a plurality of second layers are arranged to attach to a first single layer.

It is thus understood that the bimetallic devices 35 according to the invention are advantageously used to provide a resonator comprising a compensating balance spring with auxiliary thermal compensation at the balance wheel. It is particularly understood that, depending on the auxiliary compensation to be provided, the materials and the geometries that are used for the bimetallic device 35 and, possibly, for the block/inertia block 6 and/or the fixing base 9 and/or the stop means 11, 13, 15, 17 will be selected in order to adjust the working of the timekeeping movement as precisely as possible. It is also possible to adjust the position of the bimetallic device 35 on the rim 33 in order to optimise its influence.

Figure 9:
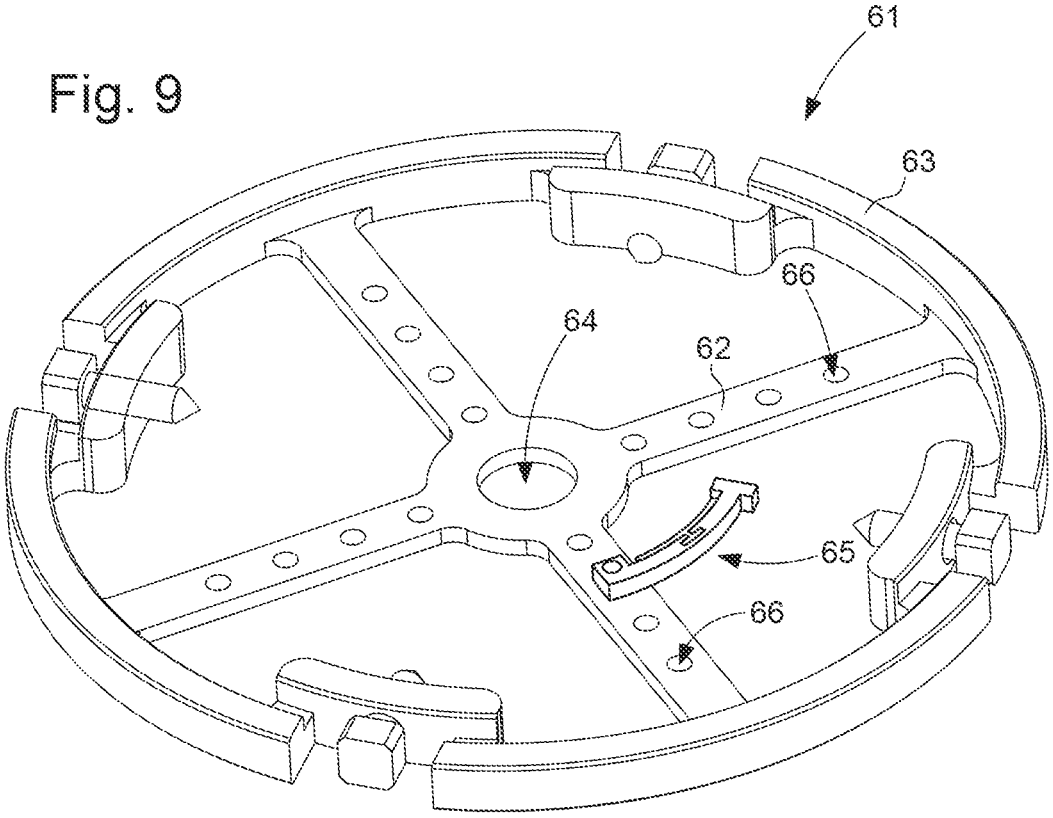

According to a third alternative shown in FIG. 9, the compensating balance wheel 61 comprises a non-cut-out rim 63 that is connected by at least one arm 62 to a central opening 64. Furthermore, said at least one bimetallic device 65 is mounted on said at least one arm 62 in order to modify the inertia of the compensating balance wheel 61 according to the temperature.

In the alternative of FIG. 9, the bimetallic device 65 comprises a strip with a projecting block, which strip is formed by a single first layer and a single second layer and is added onto the upper surface of one of the arms 62 using one of the holes 66 arranged on the arms 62. Of course, a plurality of bimetallic devices 35 can be distributed over the upper and/or lower surface of one or a plurality of the arms 62 using one or more of the holes 66.

It is also possible, in a manner similar to the example of FIG. 8, that the bimetallic device that is mounted on the upper surface of one of the arms 62 comprises a plurality of first layers arranged to attach to a single second layer or, alternatively, that a plurality of second layers are arranged to attach to a single first layer.

It is thus understood that the bimetallic devices 65 according to the invention are advantageously used to provide a resonator comprising a compensating balance spring with auxiliary thermal compensation at the balance wheel. It is particularly understood that, depending on the auxiliary compensation to be provided, the materials and the geometries that are used for the bimetallic device 65 and, possibly, for the block 6 and/or the fixing base 9 and/or the stop means 11, 13, 15, 17 will be selected in order to adjust the working of the timekeeping movement as precisely as possible. It is also possible to adjust the position of the bimetallic device 65 on each arm 62, i.e. its fixing position between the opening 64 and the rim 63, as well as the positioning relative to the length of the arm 62, i.e. the angle between the start of the bimetallic device 65 and the length of the arm 62, or the direction of the curvature of the bimetallic device (substantially parallel to the curvature of the rim 63 or opposite the curvature), in order to optimise its influence.

According to a second embodiment, the invention relates to a compensating index 71, 91 comprising at least one bimetallic device 75, 95 according to any of the preceding variants.

Consequently, the bimetallic device 75, 95 according to the invention advantageously can be used to provide a resonator with high-precision auxiliary thermal compensation through the indexing.

Indeed, the index is used to modify the daily working of the timepiece, by extending or shortening the active length of the balance spring of a balance wheel-balance spring resonator. The index is normally adjusted with low friction on the top balance-endpiece. The daily working of the timepiece is modified by turning the index. In order to simplify the adjustment, graduations are generally marked on the balance-cock that allow the effect of the alteration to be approximately assessed.

Figure 10:
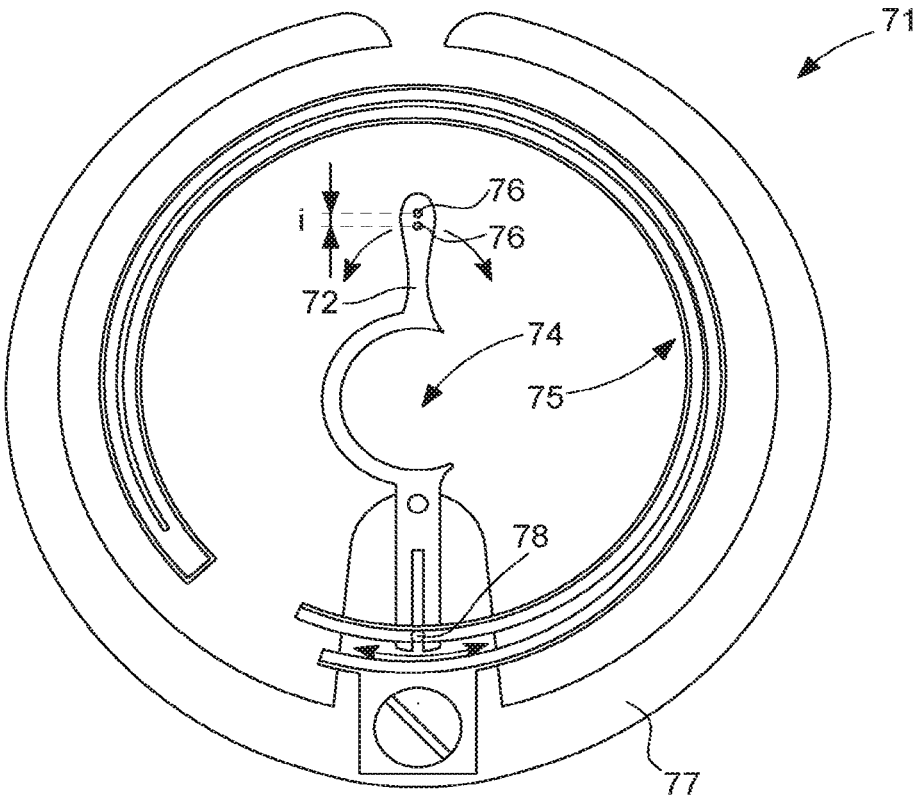
FIGS. 10 and 11 show alternative representations of a second embodiment using a bimetallic device according to the invention.

According to a first alternative shown in FIG. 10, the compensating index 71 comprises a gap i that is arranged to receive a hairspring formed in an arm 72. The arm 72 is rotationally mounted relative to an opening 74 and is connected to said at least one bimetallic device 75 in order to modify the position of the gap i, i.e. the clearance of the balance spring, according to the temperature.

More specifically, the bimetallic device 75 comprises a concentrically extending U-shaped strip that is formed by a single first layer and a single second layer. The bimetallic device 75 is mounted between the arm 72 supporting two pins 76 or, alternatively, an index key, forming the gap i, and a fixing ring 77 at the top balance-endpiece. As shown in FIG. 10, one end 78 of the strip is pivotally mounted on the arm 72 in order to force said arm to move during temperature variations.

It is thus understood that the arm 72 and/or the pins 76 and/or a section of the strip of the bimetallic device 75 and/or the opening 74 and/or the fixing ring 77 can be integral.

Of course, a plurality of bimetallic devices 75 can be distributed between the arm 72 and the fixing ring 77, i.e. one between the opening 74 and the start of the pins 76 and one between the opening 74 and the fixing ring 77, for example. It is also possible, in a manner similar to the example of FIG. 8, that the bimetallic device 75 that is used comprises a plurality of first layers arranged to attach to a single second layer or, alternatively, that a plurality of second layers are arranged to attach to a single first layer.

It is thus understood that the bimetallic devices 75 according to the invention are advantageously used to provide a resonator comprising a compensating balance spring with auxiliary thermal compensation at the index. It is particularly understood that, depending on the auxiliary compensation to be provided, the materials and the geometries that are used for the bimetallic device 75 and, possibly, for the block/index block 6 and/or the fixing base 9 and/or the stop means 11, 13, 15, 17 will be selected in order to adjust the working of the timekeeping movement as precisely as possible. It is also possible to adjust the position of the bimetallic device 75 in order to optimise its influence.

Figure 11:
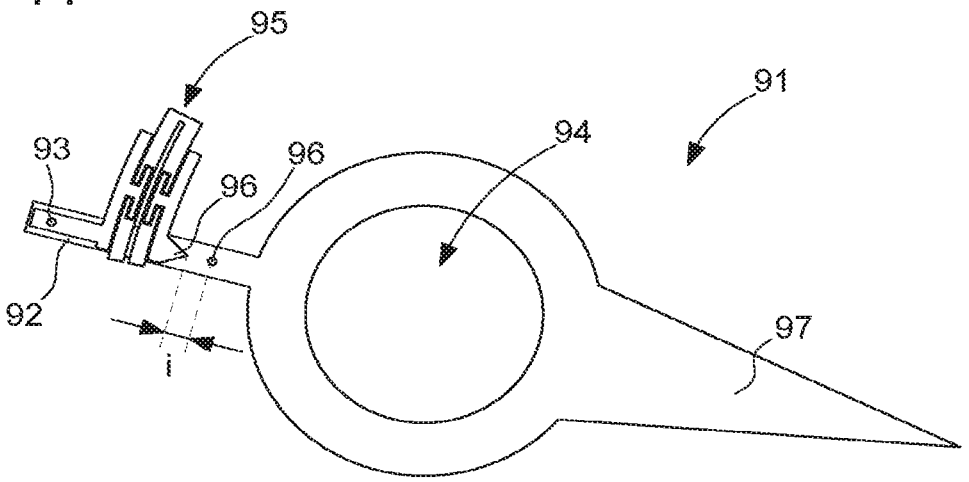

According to a second alternative shown in FIG. 11, the compensating index 91 comprises a gap i that is arranged to receive a hairspring formed in an arm 92. The arm 92 is preferably rotationally mounted relative to an opening 94. Furthermore, the size of the gap i is advantageously controlled by said at least one bimetallic device 95 in order to modify the gap i according to the temperature.

More specifically, the bimetallic device 95 comprises a U-shaped strip that is formed by a single first layer and a single second layer. The bimetallic device 95 is mounted on the arm 92 at one 93 of its ends and comprises a first pin 96 on its other end. A second pin 96 is mounted on the arm 92 opposite the first pin in order to form the gap i and an index tip 97 is mounted opposite the arm 92 relative to the opening in order to allow the index 91 to be adjusted.

It is thus understood that the arm 92 and/or the pins 96 and/or a section of the strip of the bimetallic device 95 and/or the opening 94 and/or the index tip 97 can be integral.

Of course, a plurality of bimetallic devices 95 can be distributed between the arm 92 and the index tip 97, i.e. by including a second device between the opening 94 and the start of the pins 96, for example. It is also possible, in a manner similar to the example of FIG. 8, that the bimetallic device 95 that is used comprises a plurality of first layers arranged to attach to a single second layer or, alternatively, that a plurality of second layers are arranged to attach to a single first layer.

It is thus understood that the bimetallic devices 95 according to the invention are advantageously used to provide a resonator comprising a compensating balance spring with auxiliary thermal compensation at the index. It is particularly understood that, depending on the auxiliary compensation to be provided, the materials and the geometries that are used for the bimetallic device 95 and, possibly, for the block/index block 6 and/or the fixing base 9 and/or the stop means 11, 13, 15, 17 will be selected in order to adjust the working of the timekeeping movement as precisely as possible. It is also possible to adjust the position of the bimetallic device 95 in order to optimise its influence.

It also can be contemplated that a bimetallic device of the type shown in FIG. 11 can be adapted so as not to modify the position of an index pin but to modify the position of the pinning point of a balance spring according to the temperature. It is thus understood that the bimetallic device will be mounted between a fixed point of the timekeeping movement, such as a beam, and the external curve of a balance spring so that the active length of the balance spring can be modified according to the temperature without having to use an index.

Figure 12:
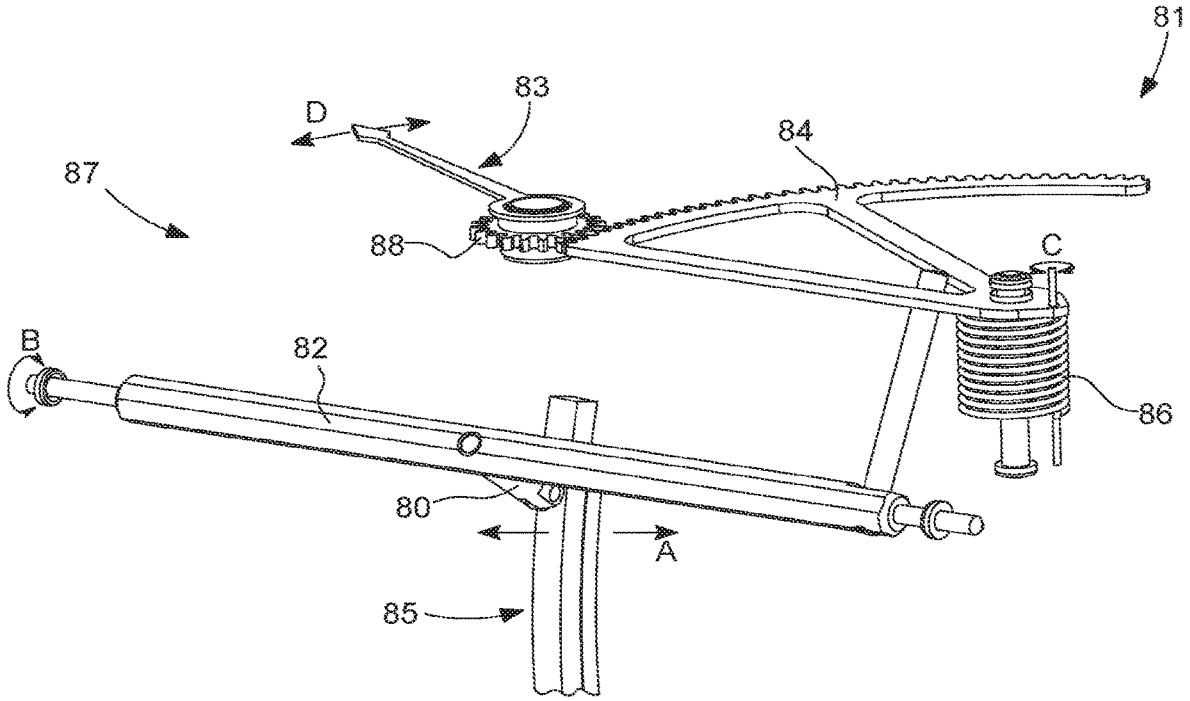
FIG. 12 shows a representation of a third embodiment using a bimetallic device according to the invention.

According to a third embodiment shown in FIG. 12, the invention relates to a temperature sensor 81 comprising at least one bimetallic device 85 according to any of the preceding variants.

Consequently, the bimetallic device 85 according to the invention advantageously can be used for high-precision temperature measurement.

In the example of FIG. 11, the temperature sensor 81 thus can comprise a pointer 83 and a flexible device 87 for tracking the movement of said at least one bimetallic device in order to modify the position of the pointer 83 according to the temperature.

More specifically, the bimetallic device 85 comprises a strip, which is formed by a single first layer and a single second layer and which is mounted in order to be in permanent contact with a feeler 80 of the flexible device 87 for tracking movement. As shown in FIG. 11, the feeler 80 is rigidly connected to a pivot 82 intended to create a rotation movement B on the basis of the movements A of the bimetallic device 85. The pivot 82 communicates its movement B to the counter gear 84 that is pivotally mounted according to the rotation C via the spring 86 in order to force the feeler 80 to always follow the surface of the bimetallic device 5. As shown in FIG. 11, the counter gear 84 engages with the gear 88 of the pointer, which is like a hand, for example, in order to move the temperature indication according to the rotation movement D.

Of course, a plurality of bimetallic devices 85 can be used to indicate an average temperature value via a differential. It is also possible, in a manner similar to the example of FIG. 8, that the bimetallic device 85 that is used comprises a plurality of first layers arranged to attach to a single second layer or, alternatively, that a plurality of second layers are arranged to attach to a single first layer.

It is thus understood that the bimetallic devices 85 according to the invention are advantageously used to provide temperature measurement precision. It is particularly understood that, depending on the measurement precision to be provided, the materials and the geometries that are used for the bimetallic device 85 and, possibly, for the block 6 and/or the fixing base 9 and/or the stop means 11, 13, 15, 17 will be selected in order to adjust the operation of the temperature sensor as precisely as possible. It is also possible to adjust the position of the bimetallic device 85 in order to optimise its use.

Of course, the present invention is not limited to the example shown, but is susceptible to various variants and modifications that will become apparent to persons skilled in the art. In particular, increasing numbers of the components that are made for a time-keeping part are silicon-based. For this reason, any silicon-based component can be modified during manufacturing to integrate a bimetallic device according to the invention such as, for example, the balance spring or the escapement.

Thus, by way of an example, according to a fourth embodiment, the invention relates to a compensating balance spring comprising at least one bimetallic device. Indeed, the bimetallic device according to the invention particularly can be advantageously used to provide a resonator with high-precision auxiliary thermal compensation at the pinning point.

More specifically, the compensating balance spring thus can comprise an overcoil that is connected, as one-piece or not as one-piece, to said at least one bimetallic device that is arranged to be fixed to a beam in order to modify the active length of the compensating balance spring according to the temperature.

What is claimed is:

1. A bimetallic device comprising:

at least one first silicon-based layer;

at least one second metal-based layer; and a stopping device configured to engage an outer surface of each of the at least one first silicon-based layer and the at least one second metal-based layer, wherein said at least one first and at least one second layers are attached to each other so that a curvature of the bimetallic device varies according to the temperature, wherein a radius of curvature of the at least one first layer is different than a radius of curvature of the at least one second layer, wherein an arc length of the at least one first layer is different than an arc length of the at least one second layer, wherein the stopping device is configured to limit at least one of the minimum and maximum curvature variations of the bimetallic device, and wherein the stopping device includes a portion that extends along and out of contact with a side surface of each of the first and second layers, and a portion that is configured to engage the outer surface of each of the first layer and the second layer.

2. The bimetallic device according to claim 1, wherein said at least one first silicon-based layer comprises monocrystalline silicon, doped monocrystalline silicon, polycrystalline silicon, doped polycrystalline silicon, porous silicon, silicon oxide, quartz, silica, silicon nitride or silicon carbide.

3. The bimetallic device according to claim 1, wherein said at least one second metal-based layer comprises silver, magnesium, lead, thallium, nickel, copper, zinc, gold, aluminium or indium or vulcanite.

4. The bimetallic device according to claim 1, wherein, under the ambient temperature and pressure conditions, the bimetallic device forms a curved strip.

5. The bimetallic device according to claim 1, wherein said at least one first and one second layers are attached to each other by nesting.

6. The bimetallic device according to claim 1, wherein said at least one first and at least one second layers are attached to each other by using a bonding material.

7. The bimetallic device according to claim 1, wherein said at least one second layer is electroformed on said at least one first layer.

8. The bimetallic device according to claim 1, wherein the bimetallic device comprises a fixing base integral with one of said at least one first and at least one second layers that allows the bimetallic device to be mounted on a part.

9. The bimetallic device according to claim 1, wherein the bimetallic device comprises a block integral with the end of one of said at least one first and at least one second layers that allows the influence of the bimetallic device to be enhanced.

10. The bimetallic device according to claim 1, wherein the stopping device contacts an outer side surface of each of the at least one first silicon-based layer and the at least one second metal-based layer.

11. The bimetallic device according to claim 1, wherein the bimetallic device comprises a plurality of first layers arranged to attach to a single second layer.

12. The bimetallic device according to claim 11, wherein each of the plurality of first layers is attached on a same side of the single second layer.

13. The bimetallic device according to claim 1, wherein the bimetallic device comprises a plurality of second layers arranged to attach to a single first layer.

14. The bimetallic device according to claim 13, wherein each of the plurality of second layers is attached on a same side of the single first layer.

15. A compensating balance wheel comprising at least one bimetallic device according to claim 1.

16. The compensating balance wheel according to claim 15, wherein the compensating balance wheel comprises a cut-out rim that is formed by at least two bimetallic devices, each connected by at least one arm to a central opening in order to modify the inertia of the compensating balance wheel according to the temperature.

17. The compensating balance wheel according to claim 15, wherein the compensating balance wheel comprises a non-cut-out rim connected by at least one arm to a central opening and wherein said at least one bimetallic device is mounted on the rim in order to modify the inertia of the compensating balance wheel according to the temperature.

18. The compensating balance wheel according to claim 15, wherein the compensating balance wheel comprises a non-cut-out rim connected by at least one arm to a central opening and wherein said at least one bimetallic device is mounted on said at least one arm in order to modify the inertia of the compensating balance wheel according to the temperature.

19. A compensating index comprising at least one bimetallic device according to claim 1.

20. The compensating index according to claim 19, wherein the compensating index comprises a gap that is arranged to receive a hairspring and is connected to said at least one bimetallic device in order to modify the position of the gap according to the temperature.

21. The compensating index according to claim 19, wherein the compensating index comprises a gap that is arranged to receive a hairspring, the size of the gap being controlled by said at least one bimetallic device in order to modify the gap according to the temperature.

22. A temperature sensor comprising at least one bimetallic device according to claim 1.

23. The temperature sensor according to claim 22, wherein the temperature sensor comprises a pointer and a flexible device for tracking the movement of said at least one bimetallic device in order to modify the position of the pointer according to the temperature.

24. A compensating balance spring comprising at least one bimetallic device according to claim 1.

25. The compensating balance spring according to claim 24, wherein the overcoil of the compensating balance spring is connected to said at least one bimetallic device that is arranged to modify the active length of the compensating balance spring according to the temperature.

* * * * *